United States Patent [19]

Laughton et al.

[11] 4,204,352

[45] May 27, 1980

[54] INDEX-SELECTOR DEVICES

[75] Inventors: Malcolm Laughton, Birmingham; Sidney H. Robinson, Redditch, both of England

[73] Assignee: Laughton & Sons Limited, Birmingham, England

[21] Appl. No.: 886,683

[22] Filed: Mar. 15, 1978

[51] Int. Cl.[2] ..... B42F 17/20

[52] U.S. Cl. ..... 40/389

[58] Field of Search ..... 40/389, 388, 532, 381

[56] References Cited

U.S. PATENT DOCUMENTS

| | | | |
|---|---|---|---|
| 2,513,422 | 7/1950 | Neilsen | 40/389 |
| 2,717,605 | 9/1955 | Lang | 40/389 |
| 2,822,633 | 2/1958 | Munson | 40/389 |
| 3,073,049 | 1/1963 | Levesque | 40/389 |
| 3,835,560 | 9/1974 | Mori | 40/389 |

FOREIGN PATENT DOCUMENTS

| | | | |
|---|---|---|---|
| 1012286 | 7/1957 | Fed. Rep. of Germany | 40/389 |
| 584181 | 10/1958 | Italy | 40/388 |

*Primary Examiner*—Louis G. Mancene
*Assistant Examiner*—Wenceslao J. Contreras
*Attorney, Agent, or Firm*—Kemon & Estabrook

[57] ABSTRACT

In an index selector device of the kind for use with a stack of index cards housed between a base and a lid hinged together and having a selector on the lid to release the lid after moving card-engaging members into engagement with a card so as to raise all the cards in the stack above the one required, the selector is a plurality of push buttons, one to each card-engaging member, arranged in two rows at right angles to the hinge. Interengaging inclined surfaces on each push button and card-engaging member cause lateral sliding movement of the card-engaging member on depression of the push button. A hook on the card-engaging member moves under the edge of the card above the one required and co-operating inclined surfaces on the inner end of the card-engaging device and a central catch bar cause the catch bar to release the lid. A barb on the card-engaging member hooks into a recess on the catch bar to hold the card-engaging member in the card-engaging position while the lid is open. A tongue on the catch bar which yields when the lid opens strikes an abutment as the lid closes and pushes the catch bar back to disengage the barb from the recess and release the card-engaging member to its normal position.

13 Claims, 9 Drawing Figures

INDEX-SELECTOR DEVICES

This invention relates to index selector devices of the kind used with a stack of index cards which are alphabetically or otherwise conveniently arranged and are separably mounted between a base and a lid which are hingedly connected together, the cards being hinged at their edges adjacent to the lid hinge, and the selector device having manually operable selector means mounted on the lid which when actuated releases the lid and raises all the cards in the stack above the one required for use.

Previously in some known devices of this kind the selector means has comprised a dial or sliding selector, the dial or slider being linked to card-engaging means which is actuated, when the dial or slider is moved, to engage a card above the one selected. In another known selector device of this kind the selector means comprises a set of keys mounted along one edge of the lid and on depression of a selected key a blade linked with the key is urged inwards between two cards in the stack.

It is an object of the present invention to provide an index selector device of the kind used with a stack of index cards which are separably mounted between a base and a lid connected by a hinge, the cards being hinged at their edges adjacent to the lid hinge and the selector device having manually operable selector means which when actuated releases the lid and raises all the cards in the stack above the one required for use wherein the selector means comprises a plurality of push button and a plurality of card-engaging devices mounted in the lid, the push button being distributed over an upper surface of the lid, each push button being associated with a respective one of the card-engaging devices and with a lid-releasing device, the arrangement being such that on depression of a selected push button the associated card-engaging device moves to engage a card and the lid-releasing device releases the lid so that all the cards in the stack above the one required are raised with the lid.

The push buttons are preferably arranged generally symmetrically over an upper surface of the lid and spaced inwardly from its outer edges.

Preferably the card engaging device includes means adapted to engage with the lid-releasing device such that when the device is moved to release a card it actuates the lid-releasing device to release the lid.

An embodiment of the invention will now be described, by way of example, with reference to the accompanying drawings, in which.

Figure 1:
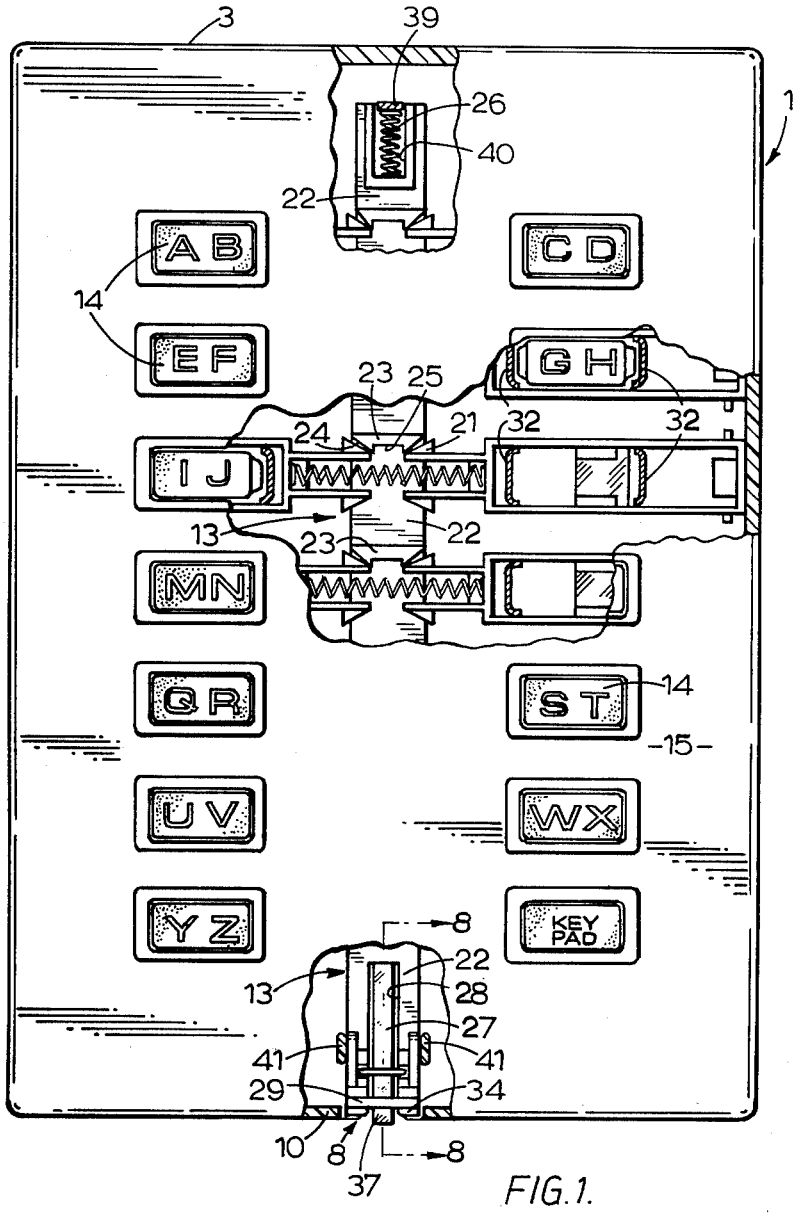
FIG. 1 is a partially cut away plan view of an index selector device according to the invention in its closed position.

The index selector device illustrated in the Figures comprises a shallow rectangular box 1 having a base 2 and a hollow lid 3. The lid 3 is connected by a hinge to the base 2 along one of the shorter edges of the box. The hinge is formed by a horizontal pivot rod 4 (FIG. 2) passing through aligned openings in depending brackets in the lid and upwardly extending brackets in the base. The lid 3 is urged towards the open position shown in FIG. 2 by means of torsion springs 7 mounted on the rod and acting between the base 2 and the lower surface 6 of the lid. The lid is normally retained in the closed position shown in FIG. 1 by means of a lid-releasing device comprising a latch 8 mounted in the lid at the opposite end to the pivot rod 4 and engaging in a slot 9 in a front wall 10 of the base 2. The slot 9 forms a keeper for the latch 8.

A stack 11 of mutually separable index cards is mounted in the box 1 on a raised card stand in the base 2. The cards are hinged by curved hooks 5 upstanding from the card stand at the end adjacent to the pivot rod 4 which pass through aligned holes in the stack 11 and through slots provided in the undersurface of the lid 3. Each card in the stack is cut back to a characteristic extent on its two longer sides, the length of the cut-back portions on successive cards varying progressively throughout the stack.

Figure 4:
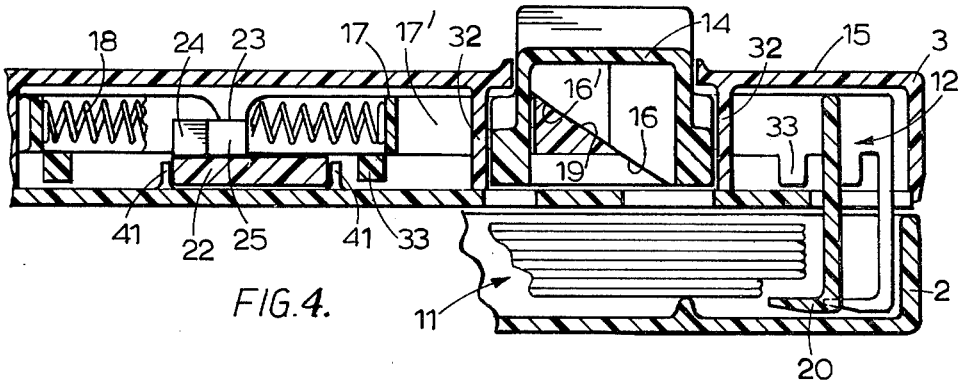
FIG. 4 is a partial section on the line 4—4 of FIG. 3.
Figure 5:
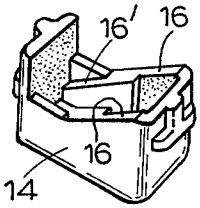
FIGS. 5 and 6 are perspective views of certain of the components of the selector device of FIG. 1.

Card engaging devices 12 for each card and a lid-releasing device 13 are mounted in the hollow lid 3. The devices 12, 13 are actuated by push buttons 14 which are mounted between spaced guides 32 inside the hollow lid 3. The push buttons 14 extend out and above the upper surface 15 of the lid through slots provided in two rows along the lid and spaced inwards from the edges of the lid. One of the push buttons 14 is shown removed from the lid and inverted in FIG. 5. Each button 14 has a wedge-shaped cam 16 having a cam surface which faces downwards and inwards towards the central longitudinal axis of the lid, as shown in FIG. 4. The push buttons 14 are of hollow construction and each is provided with interior cam surfaces 16′ which continue the cam surface 16 inside the button.

Figure 6:
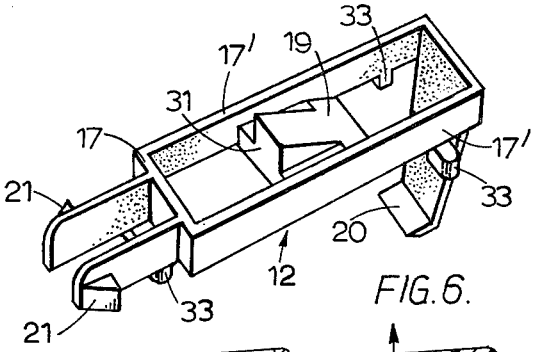

The card engaging devices 12, one of which is shown separately in FIG. 6, comprise slide bars 17 slidably mounted in the lid and extending transversely on opposite sides of its longitudinal central axis. Each slide bar 17 is located for sliding by side walls 17′ which straddle the guides 32 and by feet 33 which rest on the lower inside surface of the hollow interior of the lid. Adjacent slide bars 17 on opposite sides are urged apart by compression springs 18 acting between their centrally positioned inner ends. Each slide bar 17 has a cam surface 19 facing outwardly away from the central axis of the lid and engaging with the surface of the associated cam 16 on one of the push buttons 14. The cam surface 19 is partly formed on a wedge-shaped projection 31 narrow enough to enter the hollow interior of the button 14 and engage the interior cam 16′. The cam surface 19 and the cam surfaces 16 and 16′ together constitute interengaging formations. The card engaging devices 12 also comprise depending hooks 20 integral with the outer ends of the slide bars 17 adjacent to the side walls of the box. In the closed position of the box shown in FIG. 1 the hooks 20 are movably aligned in two rows, one on each side of the stack and at right angles to the pivot rod 4 and therefore to the axis of the hinge. The hooks 20 extend through slots in the lower surface 6 of the lid and towards the base 2. Each hook 20 is normally positioned adjacent to but spaced from a corresponding overlapping portion between two of the cards at the cut away side edges of the card stack 11. Wedge shaped barbed extensions 21 are mounted at the inner ends of the slide bars 17. There are two barbed extensions 21 so that a single moulding will be suitable for the slide bars on opposite sides of the central axis of the lid but only the barbed extension 21 on the hinge side of each slide bar is effective.

Figure 7:
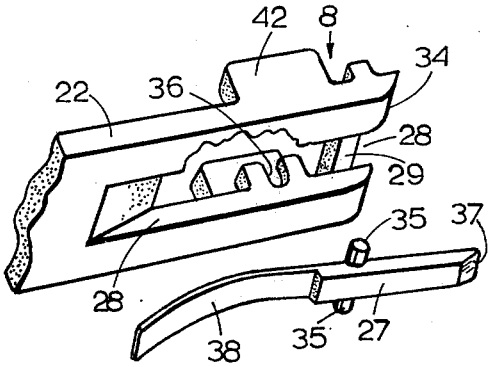
FIG. 7 is an exploded view of other portions of the selector device.
Figure 8:
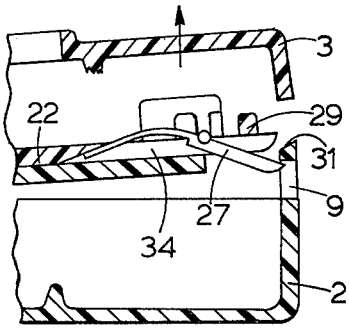
FIG. 8 is a fragmentary section as on line 8—8 of FIG. 1 but with the selector device beginning to open.
Figure 9:
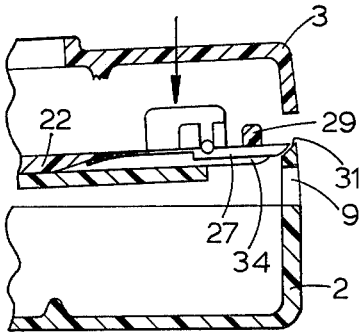
FIG. 9 is a view similar to FIG. 8 but with the selector device almost closed.

The lid releasing device 13 comprises a central catch bar 22 slidably mounted in the lid and located at the hinge end by a guide member 39 depending from the upper inside surface of the hollow interior of the lid and engaging a recess 40 in the catch bar 22 and, at the forward end by upper and lower rabs 41 inside the lid which embrace cheeks 42 on opposite sides of the catch bar 22. Spaced cams 23 are provided along the length of the catch bar 22 and adjacent to the inner ends of the pairs of slide bars 17. Wedge shaped surfaces 24 on the cams engage co-operating complementary surfaces on barbed extensions 21 and each cam has a central recess 25. The slide bars 17 form coupling elements between the push buttons 14 and these co-operating surfaces. The latch 8 is formed at one end of the catch bar 22 and comprises at the forward end of the catch bar 22 a nose 34 which is normally urged to its retained position in keeper slot 9 as shown in FIG. 1 by means of a spring 26 mounted between the guide member 39 and the end of the recess 40 and biasing the catch bar 22 towards the front wall 10. FIGS. 7, 8 and 9 show the lid-releasing device in greater detail. The latch 8 has a tongue 27 which is pivotally mounted by trunnions 35 in bearing recesses 36 in the catch bar 22 so that the tongue lies in a slot 28 in the end of the catch bar 22. A cross-bar 29 overlies the end of the slot 28. The portion of the tongue 27 forward of the trunnions 35 is rigid and has a tip 37 with an inclined undersurface. Behind the trunnions 35 the tongue extends as a cantilever spring 38 which acts against the undersurface of the catch bar 22 and urges the tip 37 upwards to a normal position against the cross-bar 29 which acts as a stop. In this normal position the tip 37 projects beyond the nose 34. Thus when the nose 34 of the latch 8 is released from the keeper slot 9 the tongue 27 will yield resiliently while the lid moves in a direction away from the base 2 (FIG. 8) but will be held against movement relative to the catch bar 22 by the cross bar 29 when urged in the opposite direction (FIG. 9).

Figure 2:
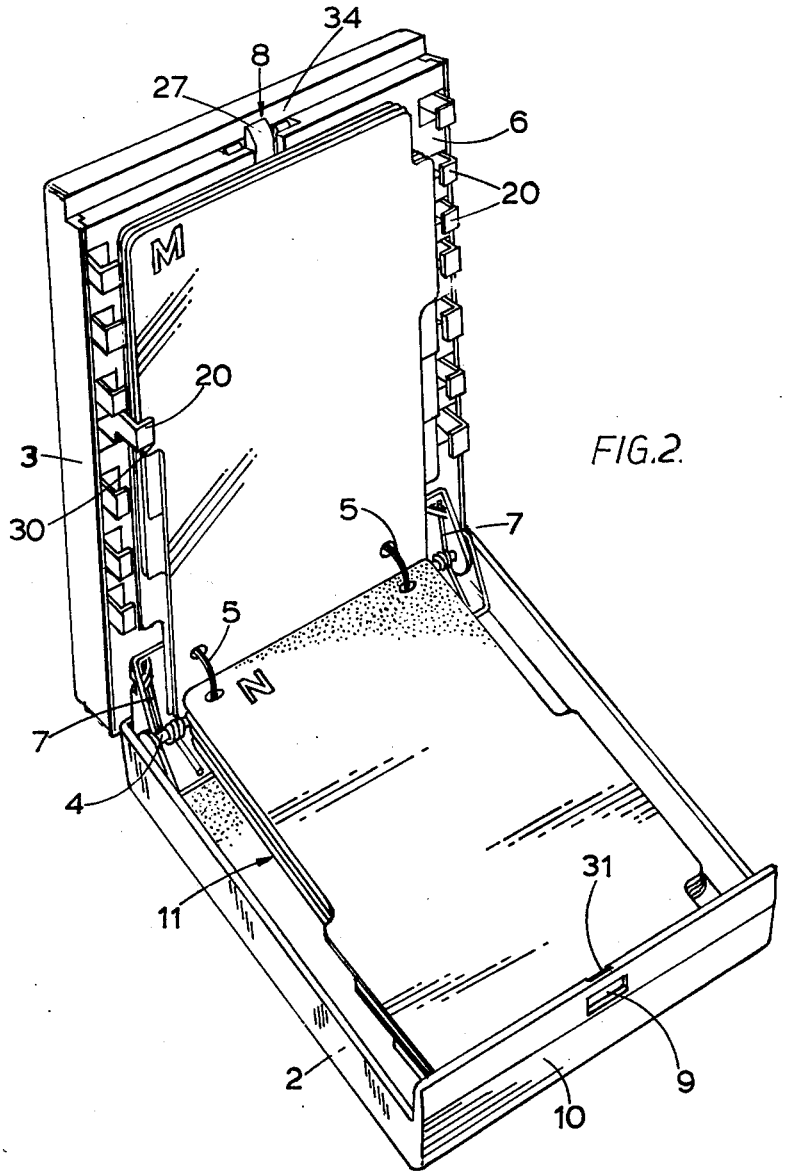
FIG. 2 is a perspective view of the device of FIG. 1 in an open position.
Figure 3:
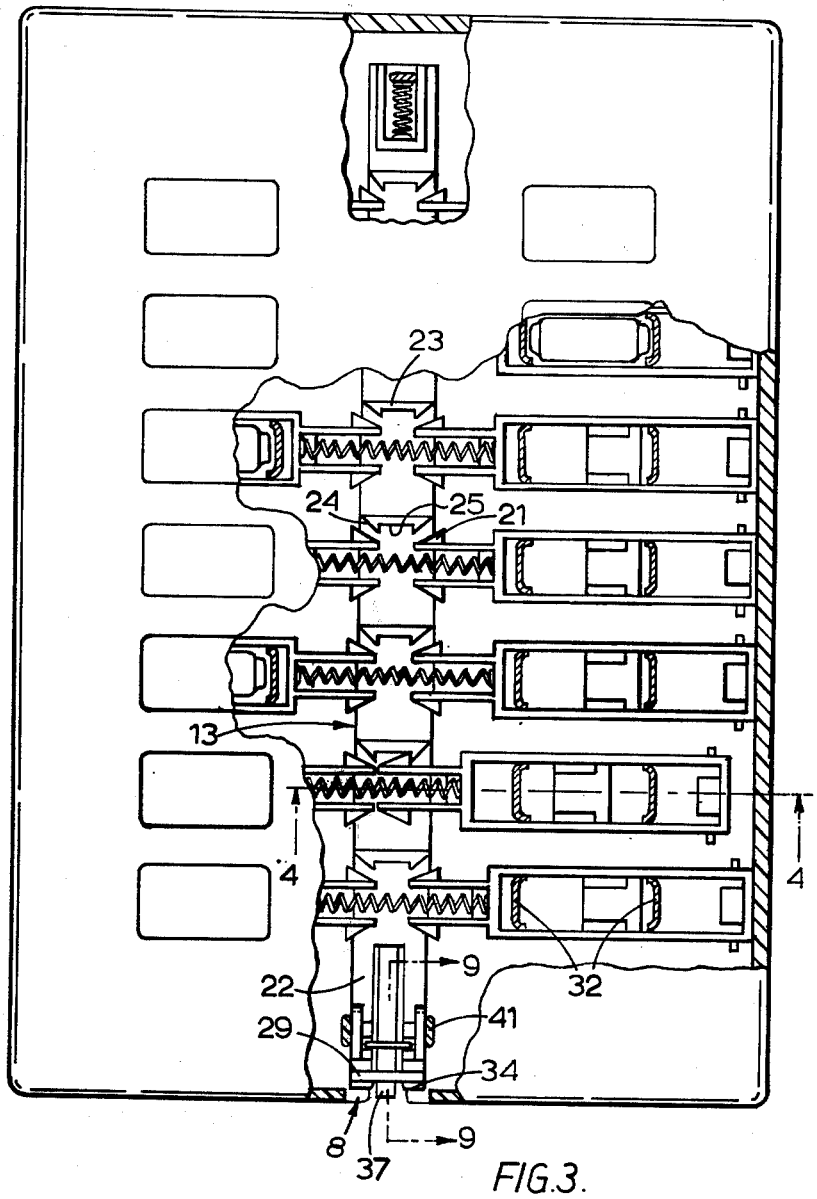
FIG. 3 is a fragmentary plan view similar to FIG. 1 but with some components in a selecting position.

In the closed position of the index selector device the components are in the positions shown in FIG. 1. When a user wishes to select one of the cards in the stack he depresses the appropriate button according to the indicating letter or marking on the outer face of the button. Downward depression of the button 14 gives rise to a camming action between the interengaging cam surfaces 16, 19 which urges the associated slide bar 17 towards the catch bar 22 and the position shown in FIGS. 3 and 4. The hook 20 at the outer end of the slide bar moves inwardly until it is positioned beneath the cut away edge of the stack 11. At the same time a camming action between the surface on the barbed extension 21 and the co-operating surface 24 on the catch bar 22 urges the catch bar towards the hinged end of the lid so that the latch 8 is released from the keeper slot 9. The barb of the barbed extension 21 moves into the cut-away portion 25 and is retained there to hold the hook in position. These inter hooking portions form retaining means holding the selected card engaging device 12 in the card engaging position. As the lid springs open under the action of the torsion springs 7 the hook 20 engages under the corresponding overlapping part 30 (see FIG. 2) between two cards, the lower of the two cards being the one corresponding to the selecting mark on the associated button 14, and thus all the cards above the one selected are raised with the lid as shown in FIG. 2. It will be understood that the overlapping parts between the cards on each edge are so arranged that each of the hooks will engage and raise the card above the one indicated on the push button associated with that hook.

When the lid is lowered towards its closed position the tip 37 of the tongue 27 engages a lip 31 on the base (FIG. 9). The lip 31 has a rearwardly inclined upper surface and forms an abutment to be engaged by the complementarily inclined undersurface of the tip 37. As the tongue 27 is held by the cross-bar 29 the engagement will act to urge the catch bar towards the hinged end of the lid causing momentary movement of the latch 8 and catch bar 22 in excess of that necessary to release the latch from the keeper slot 9 and sufficient to release the barbed extension 21 from the recess 25, whereupon the slide bar 17 moves outwardly under the action of the compression spring 18 to its released position. No longer impeded by the slide bar 17, the catch bar 22 is urged towards the front wall 10 of the base under the action of the spring 26 so that the nose 34 re-engages in the keeper slot 8. The tongue 27, lip 31 and the catch bar 22 thus form part of means for disengaging the retaining means for the card engaging device 12. The hook 20 of the card-selecting device 12, being integral with the slide bar 17 is restored to its normal position clear of the stack. The index selector device is once again in the condition shown in FIG. 1. In this embodiment most of the components apart from the parts of the hinge and the torsion and compression springs are plastics mouldings.

We claim:

1. An index selector device of the kind comprising a base and a lid, a hinge connecting the lid to the base, a stack of index cards which are separably mounted between the base and the lid, the cards being hinged at their edges adjacent to the lid hinge, a lid-releasing device normally holding the lid closed against the base, manualy operable selector means which when actuated operates the lid-releasing device to release the lid and raises all the cards in the stack above the one required for use wherein the selector means comprises a plurality of push buttons and a plurality of card-engaging devices mounted in the lid, the push buttons being distributed over an upper surface of the lid, each push button being associated with a respective one of the card-engaging devices and with a lid-releasing device, the arrangement being such that on depression of a selected push button the associated card-engaging device moves to engage a card and the lid-releasing device releases the lid so that all the cards in the stack above the one required are raised with the lid, the index selector device further comprising means for retaining each card-engaging device in its card-engaging position while the lid is open and means for disengaging said retaining means on closing the lid.

2. An index selector device as claimed in claim 1 wherein the push buttons are arranged generally symmetrically over an upper surface of the lid and spaced inwardly from the outer edges of the lid.

3. An index selector device as claimed in claim 1 wherein each card-engaging device comprises a hook movable by depression of the associated push button from a position clear of the stack to a card-engaging position in engagement with an associated card.

4. An index selector device as claimed in claim 3 wherein each hook depends from a lower surface of the lid and is mounted for movement away from the edge of the lid when moving towards the card-engaging position.

5. An index selector device as claimed in claim 4 wherein the hooks are aligned in two rows, one on each side of the stack and at right angles to the hinge axis.

6. An index selector device according to claim 1 wherein each card-engaging device comprises a slide bar slidably mounted for movement towards and away from the stack, each slide bar and its associated push button having interengaging formations, one at least of which is a cam surface, the interengaging formations being so arranged that depression of the button is effective to produce sliding movement of the slide bar such that the card-engaging device moves to engage a card.

7. An index selector device according to claim 6 wherein each card-engaging device comprises a hook rigid with the slide bar which is movable by depression of the associated push button from a position clear of the stack to a card-engaging position in engagement with an associated card.

8. An index selector device according to claim 1 wherein the means for disengaging the retaining means is operated by movement of the lid-releasing device, on closing the lid, in excess of that necessary to release the lid.

9. An index selector device according to claim 1 wherein the lid-releasing device includes a catch bar operatively coupling the push buttons to release the lid and which also forms part of the means for disengaging the retaining means.

10. An index selector device according to claim 1 wherein the means for disengaging said retaining means is coupled to the lid-releasing device and operable thereby on movement of the lid-releasing device, on closing the lid, in excess of that necessary to release the lid, the lid-releasing device comprising a latch movably mounted in the lid and having a nose co-operating with a keeper in the base and wherein a tongue is mounted on the latch, the tip of the tongue normally projecting beyond the nose for engagement with an abutment on the base to cause momentary excess releasing movement of the latch on closing the lid but the tongue being yieldable so that when the latch is released by depression of one of the push buttons to open the lid the tongue can pass the abutment without causing excess movement of the latch.

11. An index selector device according to claim 10 wherein the tongue is pivotally mounted in the latch and is resiliently urged in the upward direction of movement of the tip towards a position against a stop, in which position the tip projects beyond the nose, an undersurface of the tip and/or of an upper surface of the abutment being so inclined that when the tip strikes the abutment as the lid approaches the base the tongue pushes the latch rearwards to disengage the retaining means.

12. An index selector device of the kind comprising a base and a lid, a hinge connecting the lid to the base, a stack of index cards which are separably mounted between the base and the lid, the cards being hinged at their edges adjacent to the lid hinge, a lid-releasing device normally holding the lid closed against the base, manually operable selector means which when actuated operates the lid-releasing device to release the lid and raises all the cards in the stack above the one required for use wherein the selector means comprises a plurality of push buttons and a plurality of card-engaging devices mounted in the lid, the push buttons being distributed over an upper surface of the lid, each push button being associated with a respective one of the card-engaging devices and with a lid-releasing device, the arrangement being such that on depression of a selected push button the associated card-engaging device moves to engage a card, the lid-releasing device including a catch bar slidably mounted in the lid and, to each push button, a coupling element movable by depression of the associated push button, and the catch bar and each coupling element having co-operating formations, one at least of which is a cam surface, the co-operating formations being so shaped and arranged that sliding movement of the related coupling element on depression of the associated push button is effective to move the catch bar and release the lid.

13. An index selector device according to claim 12, wherein the catch bar is biased in the direction of sliding movement opposite to that for releasing the lid, each coupling element is spring urged to oppose depression of its associated push button and interhooking portions of the catch bar and each coupling means engageable on depression of the push button associated with the coupling element by the action of the biasing of the catch bar and disengaging by opposite movement of the catch bar on closing the lid.

* * * * *